US008006324B2

(12) United States Patent
Ophardt et al.

(10) Patent No.: US 8,006,324 B2
(45) Date of Patent: Aug. 30, 2011

(54) FOAM ODOR PLUG FOR URINALS

(75) Inventors: Heiner Ophardt, Vineland (CA); Andrew Jones, Smithville (CA)

(73) Assignee: Gotohti.com Inc., Beamsville Ontario (CA)

( * ) Notice: Subject to any disclaimer, the term of this patent is extended or adjusted under 35 U.S.C. 154(b) by 174 days.

(21) Appl. No.: 12/381,129

(22) Filed: Mar. 9, 2009

(65) Prior Publication Data

US 2010/0186156 A1 Jul. 29, 2010

(30) Foreign Application Priority Data

Jan. 27, 2009 (CA) ..... 2651241

(51) Int. Cl.
*E03D 13/00* (2006.01)

(52) U.S. Cl. ..... 4/301; 4/300; 4/222.1; 4/222; 4/668; 4/661

(58) Field of Classification Search ..... 4/301, DIG. 3, 4/300, 222.1, 190, 222, 661, 668, 310
See application file for complete search history.

(56) References Cited

U.S. PATENT DOCUMENTS 1,731,431 A * 10/1929 Meyer ..... 4/222.1
3,342,271 A 9/1967 Anthony, Jr.
3,585,649 A 6/1971 Miya
3,843,976 A * 10/1974 Miya et al. ..... 4/300
4,232,741 A 11/1980 Richardson et al.
4,321,714 A 3/1982 Takai et al.
4,442,018 A 4/1984 Rand
5,261,933 A 11/1993 Greene
5,434,192 A 7/1995 Thach et al.
5,711,037 A * 1/1998 Reichardt et al. ..... 4/301
5,945,910 A * 8/1999 Gorra ..... 340/573.1
6,401,266 B1 6/2002 Mitchell et al.
6,409,050 B1 6/2002 Ophardt
6,425,411 B1 7/2002 Gorges
6,589,440 B2 7/2003 Atwill
6,601,736 B2 8/2003 Ophardt
6,701,541 B2 3/2004 Romagna et al.
6,959,723 B2 11/2005 Gorges
6,973,939 B2 12/2005 Gorges et al.
7,246,386 B2 7/2007 Hall
7,364,053 B2 4/2008 Ophardt
2001/0009404 A1* 7/2001 Paese et al. ..... 342/28
2004/0064884 A1 4/2004 Egeresi

* cited by examiner

*Primary Examiner* — Gregory Huson
*Assistant Examiner* — Lauren Heitzer
(74) *Attorney, Agent, or Firm* — Riches, McKenzie & Herbert LLP

(57) ABSTRACT

A urinal discharge pipe assembly comprising a discharge pipe having a passageway therethrough from an inlet in communication with a urinal discharge outlet and an outlet in communication with a urine disposal system, a foam dispensing device having a foam outlet open into the passageway for discharge of an allotment of foam into the passageway between the inlet and the outlet adequate to form a temporary foam plug across the passageway blocking the passageway.

15 Claims, 8 Drawing Sheets

FOAM ODOR PLUG FOR URINALS

SCOPE OF THE INVENTION

This invention relates to a gas trap for waste outlets and, more particularly, to a temporary foam odor trap for urinals and toilets.

BACKGROUND OF THE INVENTION

Conventional urinals and toilets have a waste outlet into which urine, feces and the like passes.

Sanitation codes require the discharge conduit from a urinal be provided with a trap to contain gases which develop in the drain system. Typically, the trap is an S-shaped trap in which a residual portion of fluid fills an upwardly opening U-shaped segment of the trap providing a barrier to sewer gases and odors passing from below the trap upwardly. The upwardly facing liquid surface in the trap freely communicates via the urinal outlet with air in the washroom. Many urinals have the disadvantage that to keep liquid in the trap free of residue urine requires copious flushing with water after each use.

Conservation desires have increased the need for a reduction of water usage in flushing urinals and toilets with a view to reduce water consumption and to also reduce waste water disposal requirements. Low flush toilets are also known to be provided with an S-trap with a small diameter such that a smaller volume of flushing liquid is required in order to provide clean liquid in the trap.

Waterless or low flush urinals are also known in which a layer of oil which has a lower density than water is used in the trap to act as the odor seal. Oil-sealed odor traps suffer the disadvantage that some of the urine typically remains in the oil resulting in odors passing into a washroom area. Insofar as the oil may have disinfectant properties, the oil typically disadvantageously requires frequent cleaning and replacement, sometimes daily.

SUMMARY OF THE INVENTION

To at least partially overcome these disadvantages of previously known devices, the present invention provides a discharge tube preferably for a urinal with a temporary plug of foamed fluid.

An object of the present invention is to provide a simple plug for urinals and toilets.

Another object is to provide an arrangement for a urinal or toilet and a method of operating a urinal or toilet which reduces or avoids water usage.

In one aspect, the present invention provides a method of constraining gas within an effluent discharge pipe comprising discharging an allotment of collapsible foam comprising gas bubbles within a fluid inside the discharge tube to form a replaceable, collapsible foam plug blocking a passageway through the pipe.

In another aspect, the present invention provides a urinal discharge pipe assembly comprising a discharge pipe having a passageway therethrough from an inlet in communication with a urinal discharge outlet and an outlet in communication with a urine disposal system, a foam dispensing device having a foam outlet open into the passageway for discharge of an allotment of foam into the passageway between the inlet and the outlet adequate to form a temporary foam plug across the passageway blocking the passageway.

BRIEF DESCRIPTION OF THE DRAWINGS

Further aspects and advantages of the present invention will become apparent from the following description taken together with the accompanying drawings in which.

DETAILED DESCRIPTION OF THE DRAWINGS

Figure 1:
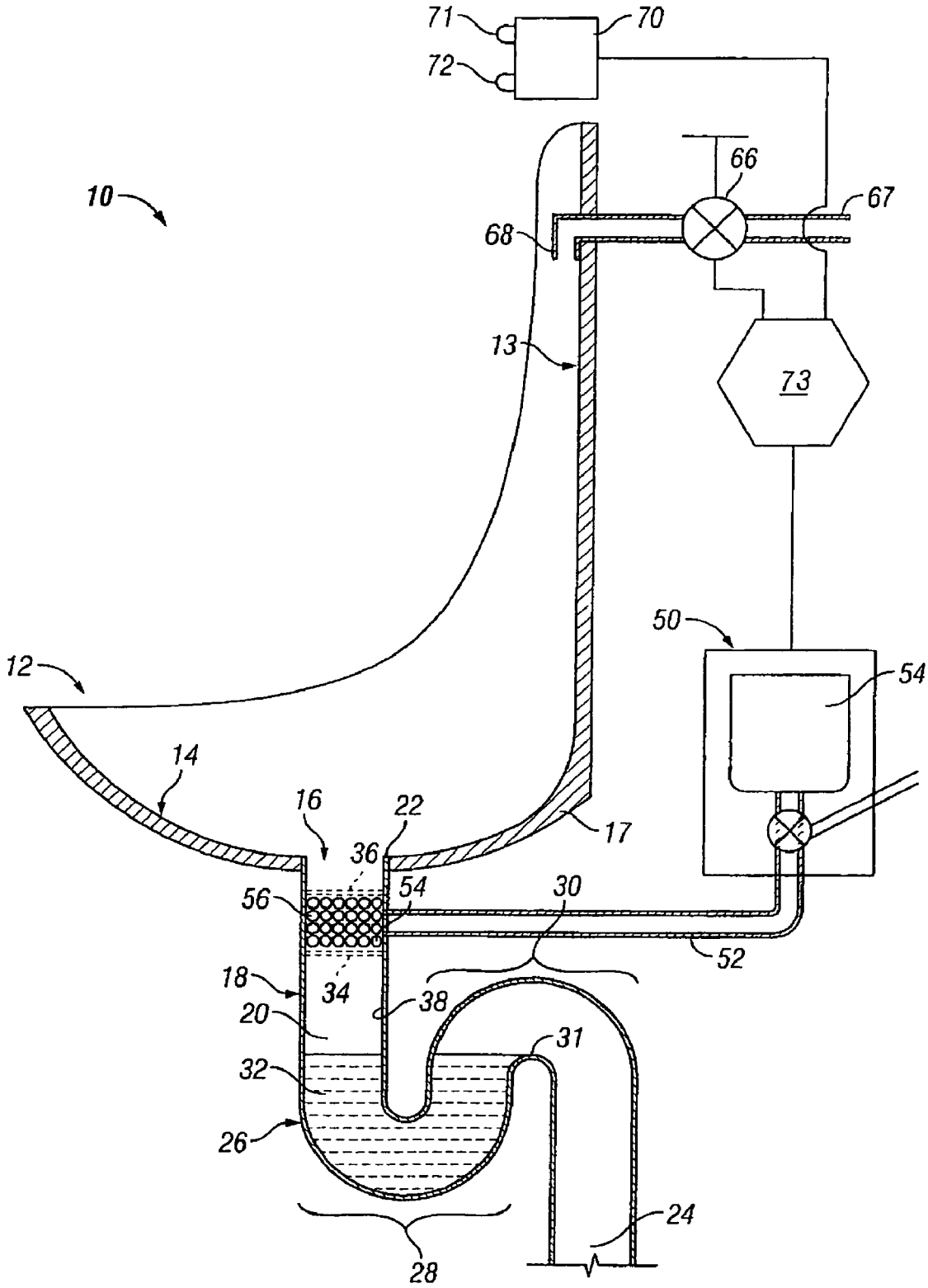
FIG. 1 is a schematic cross-sectional side view of a urinal incorporating a foam plug in accordance with a first embodiment of the present invention.

Reference is made to FIG. 1 showing a urinal assembly 10 in accordance with the first embodiment of the present invention. The assembly 10 includes a conventional urinal 12 of the type provided in men's washrooms and having an upper rear wall portion 13 merging into an upwardly convex lower bowl portion 14. The bowl portion 14 serves as a catch basin to collect fluid and direct fluid to a waste outlet 16. The waste outlet 16 is sealably coupled through the wall 17 of the urinal 12 to a discharge tube 18. The discharge tube 18 has an inlet 22 in sealed communication with the outlet 16. The discharge tube 18 has a discharge passageway 20 therethrough leading to a sewage outlet 24 in communication with a disposal system, not shown. An S-trap 26 is formed in the tube 18 by reason of the tube 18 having an S-shape portion with a first upwardly directed U-shaped sump portion 28 merging into a second downwardly directed U-shaped discharge portion 30. The S-trap 26 retains fluid 32 therein in the sump portion 28 to the height of the apex 31 of the center bight of the discharge portion 30. The retained fluid in the sump portion 28 fills the passageway 20 in the sump portion 28 forming a gas and odor seal against odors downstream of the sump portion 28 passing out the waste outlet 16.

Figure 2:
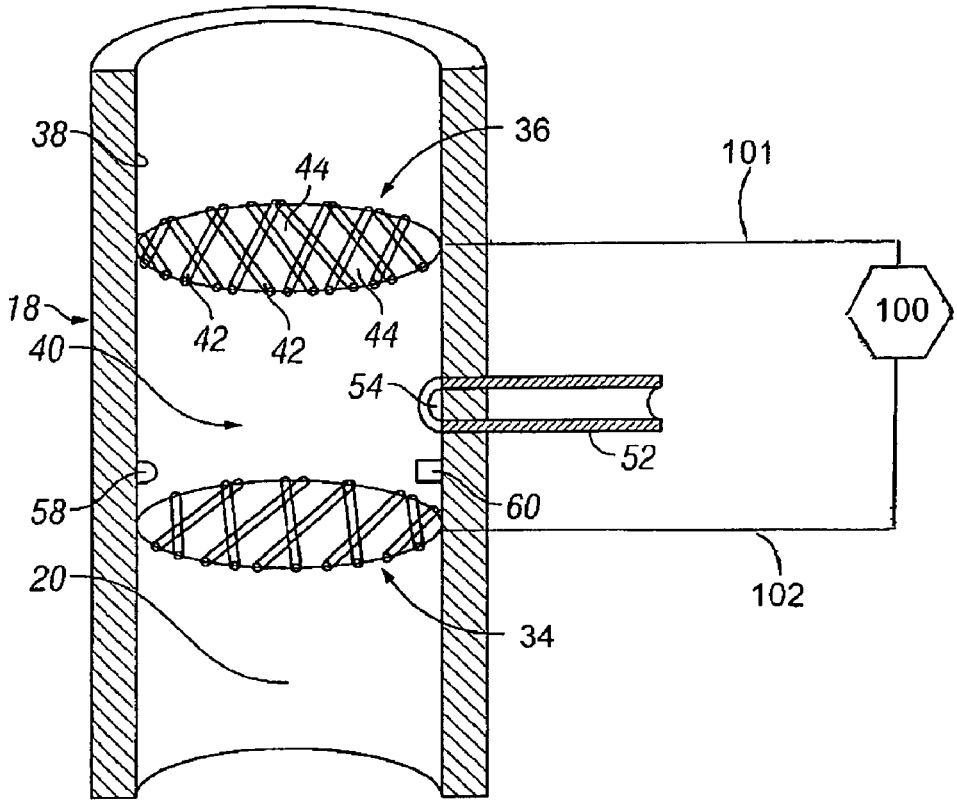
FIG. 2 is an enlarged partially sectioned pictorial side view of portions of the discharge tube of the urinal of FIG. 1 but with the foam plug not being shown.

In accordance with the present invention, there is provided in the passageway 20 between the urinal waste outlet 16 and the top of the liquid 32 in the S-trap 26 a temporary foam plug 56 schematically shown in FIG. 1 as a number of large circles representing the air bubbles in a foamable liquid. In FIG. 1, the foam plug 56 is shown as provided between a lower support member 34 and an upper support member 36 spaced axially in the passageway 20 from each other so as to define with the side wall 38 of the discharge tube 18 a chamber 40 as best seen in FIG. 2. Each of the lower support member 34 and the upper support member 36 comprises a flat circular screen fixed in the passageway 20 and extending across the entire cross-sectional area of the passageway 20. Each support member comprises a matrix, lattice or screen of criss-crossing strands 42 of relatively rigid materials such as plastic or metal providing openings 44 therebetween.

As seen in FIG. 1, the apparatus 10 includes a foam dispensing device 50. A foam delivery tube 52 extends from the foam dispensing device 50 to a foam outlet 54. As seen in FIG. 1, the delivery tube 52 extends in sealed relation through an opening in the side wall 38 of the discharge tube 18 so as to locate the foam outlet 54 in the chamber 40 above the lower support 34 and below the upper support member 36. The foam dispensing device 50 mixes atmospheric air with a foamable fluid as from a reservoir 54 to generate foam comprising air bubbles in the fluid to exit from the foam outlet 54. Typically, foam is generated by mixing air and a foamable liquid in a mixing chamber and then passing the same through porous members such as small screens in order to produce turbulence and generate foam.

Figure 3:
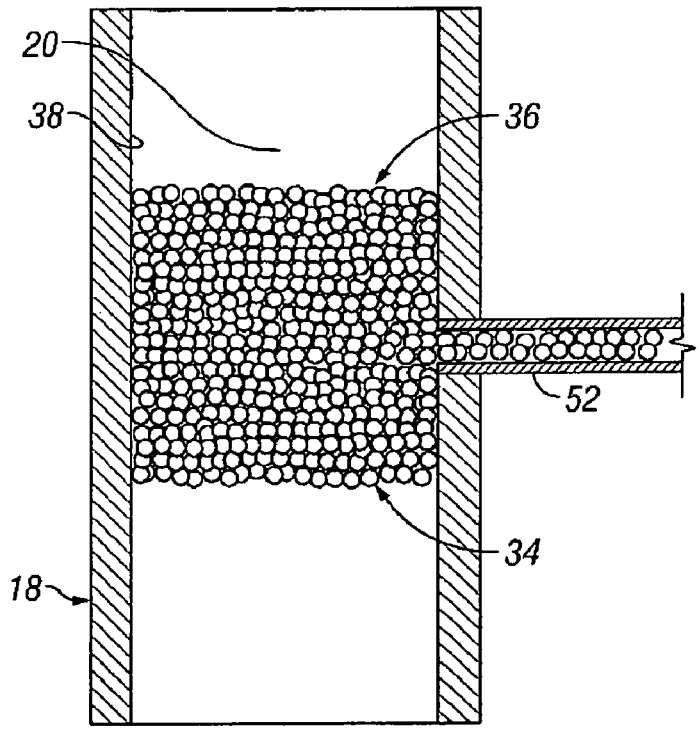
FIG. 3 is a vertical cross-sectional side view of the portions of the discharge tube shown in FIG. 2 and showing the foam plug of FIG. 1.

In operation, the foam dispensing device 50 is activated to dispense foam from the foam outlet 54 into the chamber 40. Preferably, a discrete allotment of foam is discharged which is sufficient that the foam fills the chamber 40 completely within the confines of the discharge tube 18 between the lower support 34 and the upper support 36 and, in so doing, comes to engage and adhere to the side wall 38 and the support members 34 and 36 about the cavity 40. As a result, as best seen in FIG. 3, the foam plug 56 extends across the passageway 20 blocking the passageway 20. The foam plug 56 effectively provides a barrier preventing odors from escaping upwardly therepast in the passageway 20.

The foam support members comprising the lower support member 34 and the upper support member 36 are believed to serve a number of functions including:

(a) assisting in supporting a lower portion or a lower surface of the foam plug above the fluid 32 in the S-trap 26,
  (i) against slumping or dropping down into the fluid 32 in the S-trap 26; and
  (ii) to provide a platform which assists the foam in piling up on itself as it is discharged from the foam outlet 54 so as to have the foam being discharged come to span across the passageway inside the side wall of the tube and subsequently to rise up to a height to engage the upper support as a consolidated mass of foam;

(b) restricting foam flow in the passageway past each of the lower support member 34 and the upper support member 36 to facilitate the foam being injected to substantially completely fill the passageway 20 between the lower support member 40 and the upper support member 36; and (c) assisting in maintaining the foam plug 56 stable against collapse for a longer period of time than if the foam supports were not provided.

The lower support member 34 and upper support member 36 in the preferred embodiment of FIGS. 1 to 3 are each illustrated to comprise a flat circular screen. Various alternate forms of such support members as screens or other porous elements may be useful. For example, a substitute support member may be frusto-conical whether extending radially inwardly and downwardly or radially inwardly and upwardly and the like may be truncated at their narrow end or open at their narrow end. In any such porous support member, the size of the opening through the support members may be selected to have desired sizes and the sizes may be constant throughout or may vary. Additionally, larger size openings may be provided in axial central portions of the support members.

Figure 4:
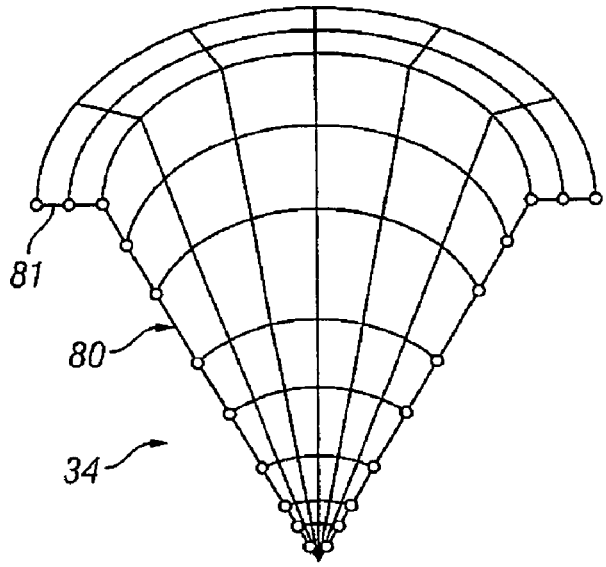
FIGS. 4, 5 and 6 are each a schematic partially cross-sectional pictorial view of a foam support member in accordance with second, third and fourth configurations in accordance with the present invention.

FIG. 4 shows a second configuration of a support member 34 comprising a screen member formed to have a conical side wall portion 80 and a radially outwardly extending flange portion 81 about the enlarged open truncated end of the conical portion 80.

Figure 5:
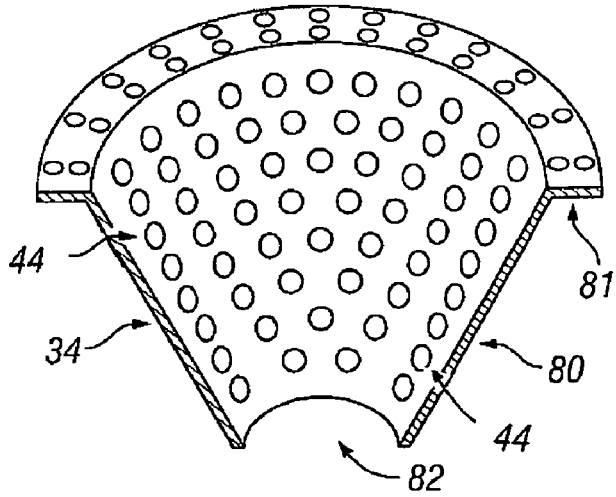

FIG. 5 shows a third configuration of a support member 34 similar to the support member shown in FIG. 4 but as a sheet of uniform thickness with openings 44 therethrough. In FIG. 5, the conical portion 80 also truncated at its smaller end providing a central opening 82 therethrough.

Figure 6:
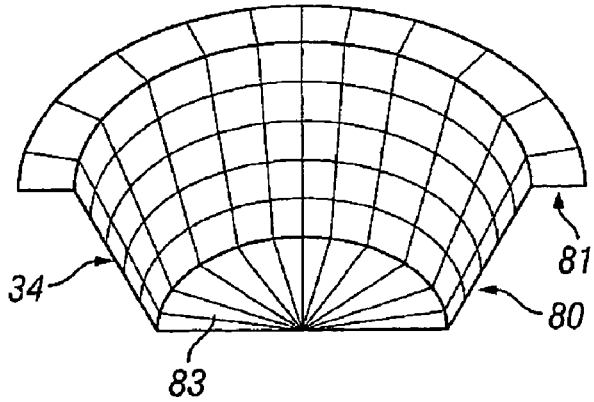

FIG. 6 shows a fourth configuration of a support member 34 similar to the support members in FIG. 4 but having the smaller truncated end of the conical portion closed via a radially extending central portion 83 as a flat disc.

Various other three-dimensional shapes for the support member 34 may be provided including, for example, with the side wall portion 80 to be arcuate or cylindrical, and with the central portion 83 to be conical or domed extending back into the side wall portion 80.

Each of the support members shown in FIGS. 4 to 6 may be provided as the lower support member 34 or as an upper support member 36. Preferably, when used as the lower support member 34, the conical portion converges downwardly, and when used as the upper support member 36, the conical portion converges upwardly although use in opposite orientations are also useful. Having a lower support member 34 with a conical portion converging downwardly is believed advantageous to provide a platform or foundation on which foam first discharged may become engaged and on which subsequently dispensed foam will rest, thus building the foam plug from the bottom of the conical potion upwardly with further discharge of the foam.

Figure 7:
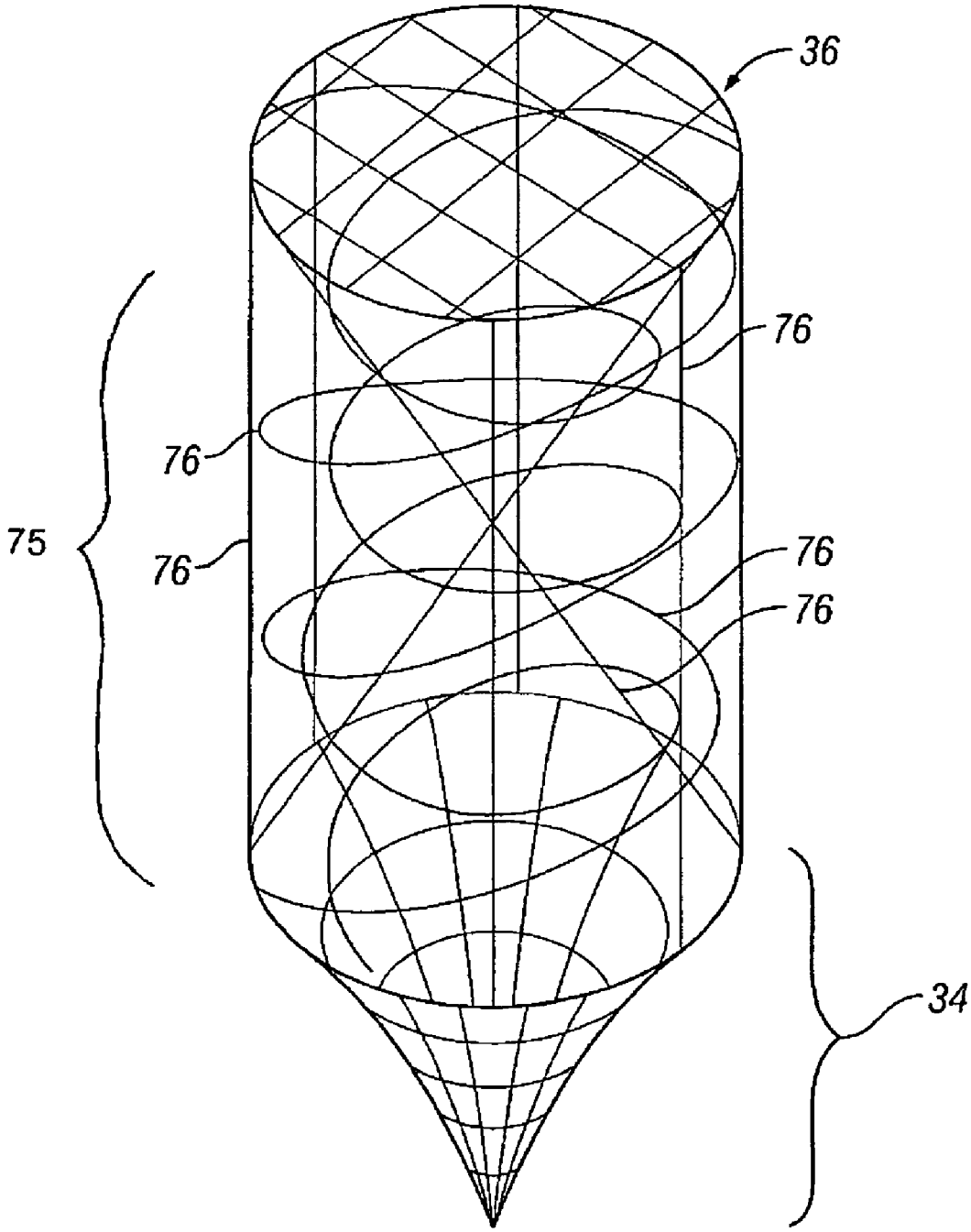
FIG. 7 is a pictorial view of a fifth configuration of a foam support member for use in accordance with the present invention.

FIG. 7 schematically illustrates a sixth configuration of a support member 74 in which the lines schematically illustrate wire members which are bonded together where they intersect. The lower support member 34 and the upper support member 36 are thus joined by an array 75 of vertically extending wire members 76 to provide a three-dimensional matrix with an outer profile corresponding to the shape of the cavity 40. The wire members 76 include diagonally extending members, helical members and the like to provide throughout the space between the lower support member 34 and the upper support member 36 support wires and openings therethrough which can be engaged by the foam and assist in supporting the foam.

Figure 8:
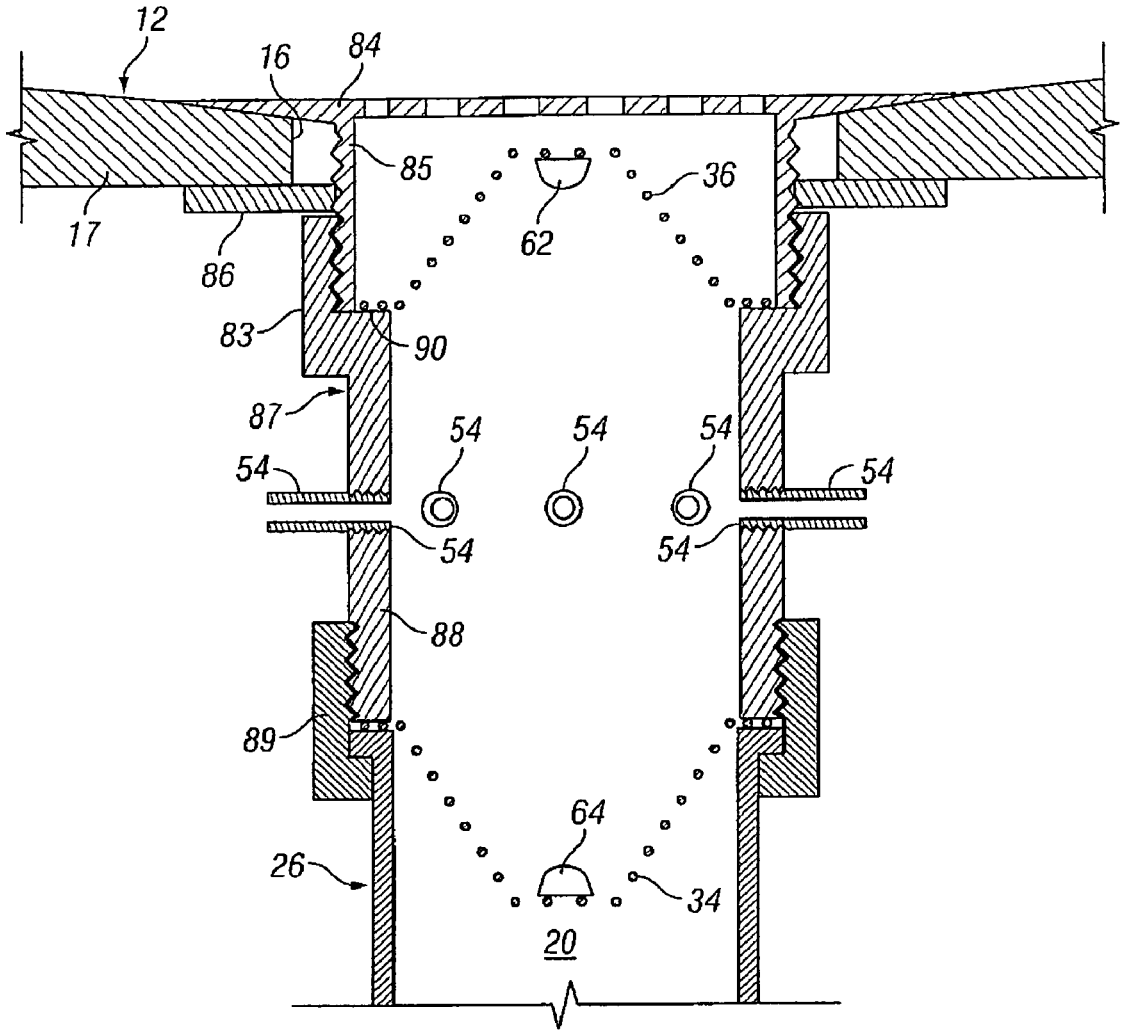
FIG. 8 is a schematic cross-sectional side view similar to FIG. 3 but of a second embodiment of a urinal discharge tube in accordance with the present invention.

Various arrangements may be made to provide a suitable cavity 40 with the foam outlet 54 opening thereinto and foam support members such as 34 and 36 located in the discharge tube 18 of a urinal. As one example, FIG. 8 illustrates in a view similar to FIG. 3, a conventional drain grate 84 secured across the discharge outlet 16 of the urinal 12 and having an externally threaded cylindrical snub tube 85 which receives a lock nut 86 to secure the grate 84 to the wall 17 of the urinal in a sealed compression fit. The threads on the snub tube 85 are also engaged by a threaded collar 83 on a tubular insert 87. The tubular insert 87 has an externally threaded lower end 88 to be engaged by a threaded collar 89 carried at an upper end of the S-trap 26.

The tubular insert 87 has an axially upwardly directed upper shoulder 90 to support an inner support member 36. A lower support member 34 has an annular flange portion engaged between abutting end shoulders of the tubular insert 87 and the S-trap 26. Nipples 90 for attachment to the foam discharge tube extend through the side wall of the tubular insert 87 in an array at circumferentially spaced locations.

In FIG. 8, the upper support member 36 may be eliminated and the grate 84 may function as an upper support member.

While merely a single discharge outlet is shown in FIGS. 1 to 3, two or more discharge outlets may be provided into the passageway 40. For example, the circular array of circumferentially arranged foam outlets 54, as shown in FIG. 8, may be advantageous to promptly form a foam plug 56 across the passageway 20 before the foam dispensed might have an opportunity to drop down into the passageway and, thus, possibly reducing the need for a foam support member in the passageway 20.

Figure 9:
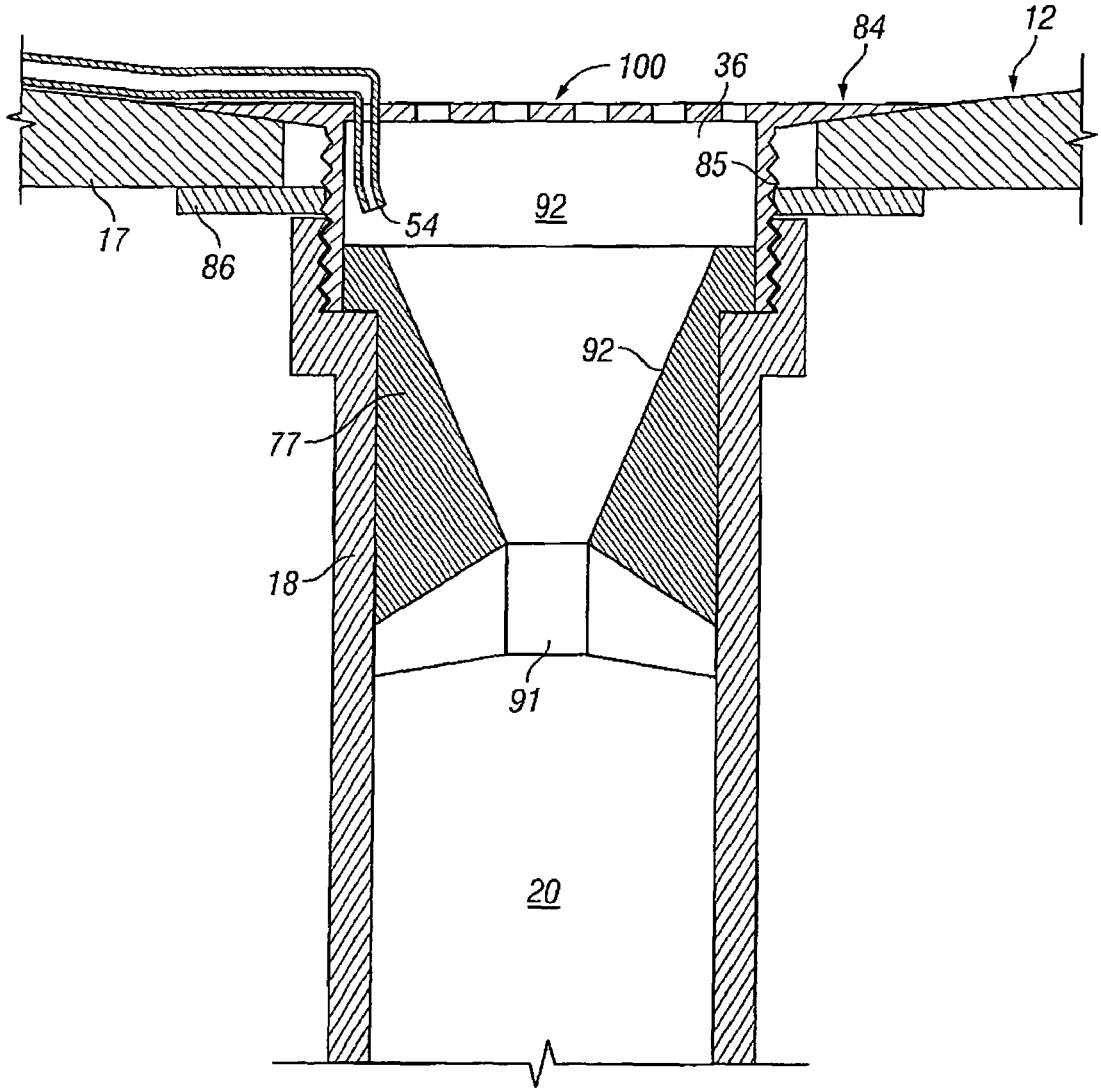
FIG. 9 is a pictorial cross-sectional view of a third embodiment of a urinal discharge tube in accordance with the present invention.

An advantageous arrangement is believed to arise when restriction to flow of the foam downwardly is provided below the foam outlet 54 into the passageway 20. In FIGS. 1 to 3, the restriction is provided by the lower support 34 as a screen. Reference is made to FIG. 9 showing a third embodiment of a urinal discharge tube in which restriction to flow of the foam downwardly is provided by a reduced cross-sectional portion 91 of the passageway 20 below the foam outlet 54 such that on injecting foam into the passageway 20, the foam will extend across the reduced portion 91 and form a lower platform of foam upon which later injected foam may be supported, with the foam to pile upon itself, rise upwardly and subsequently come to span across the enlarged cross-sectional portion 92 of the passageway 20 above the reduced cross-sectional portion 91. Formation of an adequate foam plug may be assisted by providing the passageway 20 to have the reduced cross-sectional area at or below where the foam is to be dispensed or the foam plug is to be provided. For example, a typical exit passageway 20 having an interior diameter of, for example, about 1½ inches may be reduced, for example, to about one inch or ¾ inch or ½ inch, preferably tapering downwardly, for example, conically to the reduced diameter. Such a reduction in the internal diameter of the discharge tube 18 may be provided by the use of a non-porous annular insert 77 as schematically shown in FIG. 9 to be fixed in the discharge tube 18 above the S-trap 26 and provide the passageway 20 therethrough which tapers in a conical section 92 to a reduced portion 91. The foam outlet 54 is located above the reduced diameter portion 91, with the insert 77 effectively forming a foundation or lower support on which dispensed foam will pile up on itself creating the foam plug 56 thereon and extending upwardly therefrom.

FIG. 9 illustrates an arrangement in which similar to FIG. 8, a drain grate 84 is secured across the discharge outlet 16 of the urinal 12 and has an externally threaded cylindrical stub tube 85 to which receives a lock nut 86 to secure the grate 84 to the wall of the urinal. The snub tube 85 is also engaged by a threaded collar of the discharge tube 18. The drain grate 84 has a removable, snap-fit center grate portion 100. The non-porous annular inset 77 is insertable into the waste tube 18 when the grate portion 100 is removed. The annular insert 77 sits on an upwardly directed shoulder of the waste tube 18 and provides a portion of the passageway 20. In FIG. 9, the foam delivery tube 52 extends into the bowl of the urinal 12 and down through the removable center grate portion 100 into the passageway 20 above the reduced diameter portion 91.

The preferred embodiment illustrated in FIG. 1 shows both a lower support member 34 and an upper support member 36, however, other preferred arrangements may merely have one of the lower support member 34 and the upper support member 36 albeit, the provision or use of a foam support or other restriction to foam flow downwardly is not necessary.

Figure 10:
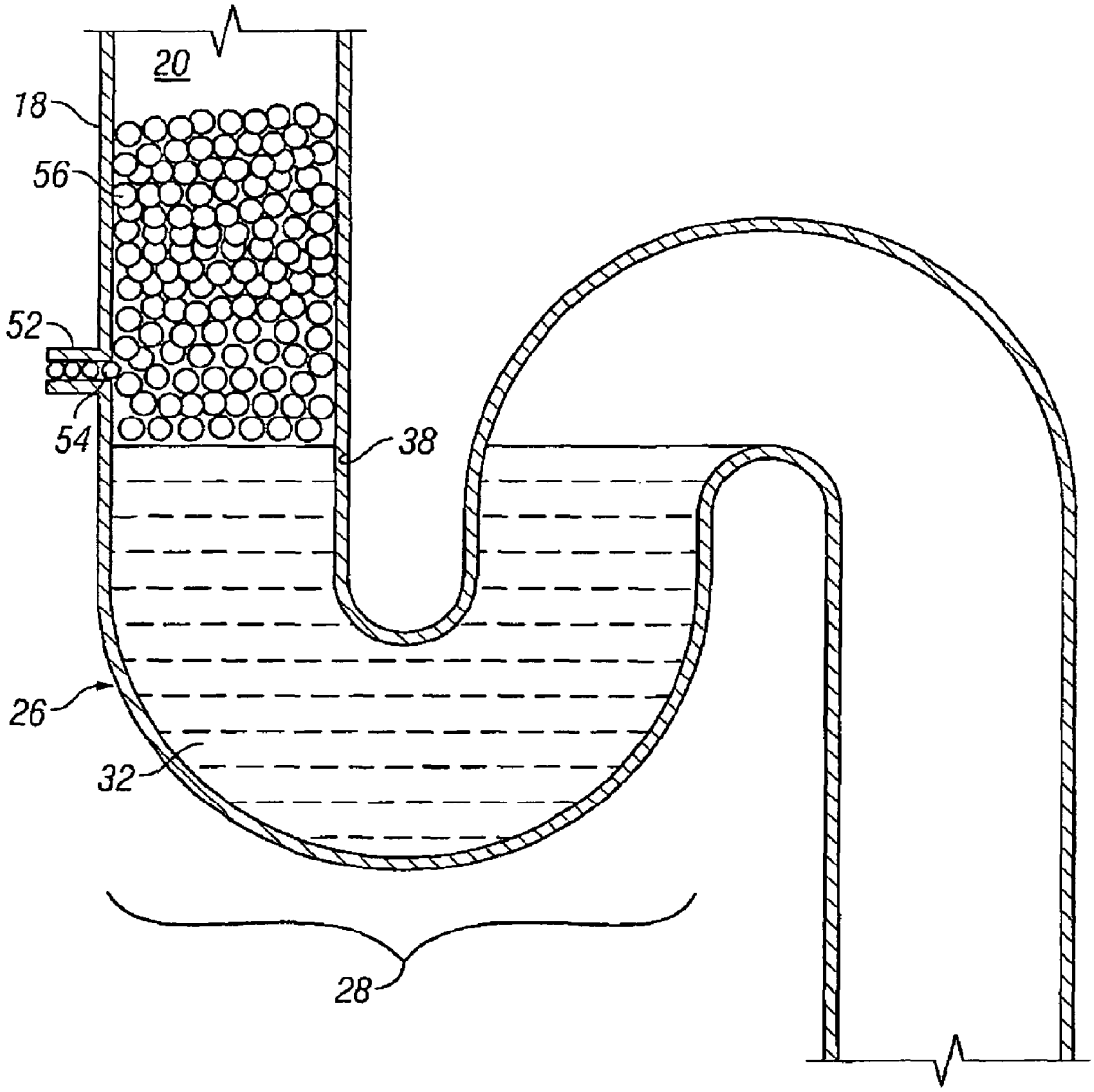
FIGS. 10 and 11 is each a cross-sectional view of a urinal discharge tube with a foam plug in accordance with fourth and fifth embodiments of the present invention.

In an embodiment shown in FIG. 10, the foam injected from the foam outlet 54 may come to rest upon the upper surface of the fluid 32 in the S-trap 26 such that the foam being injected will be temporarily supported on the fluid 32 and further injected foam will come stacked upwardly therefrom forming a foam plug 56 as seen in FIG. 10. In this arrangement, the foam in contact with the fluid 32 may have an increased tendency to collapse, however, while the foam in contact with the fluid may collapse, portions of foam spaced upwardly from the upper surface of the fluid 32 may have sufficient inherent support by its mere engagement with the side wall 38 of the discharge tube 18 to maintain a foam plug for a useful plug life.

Figure 11:
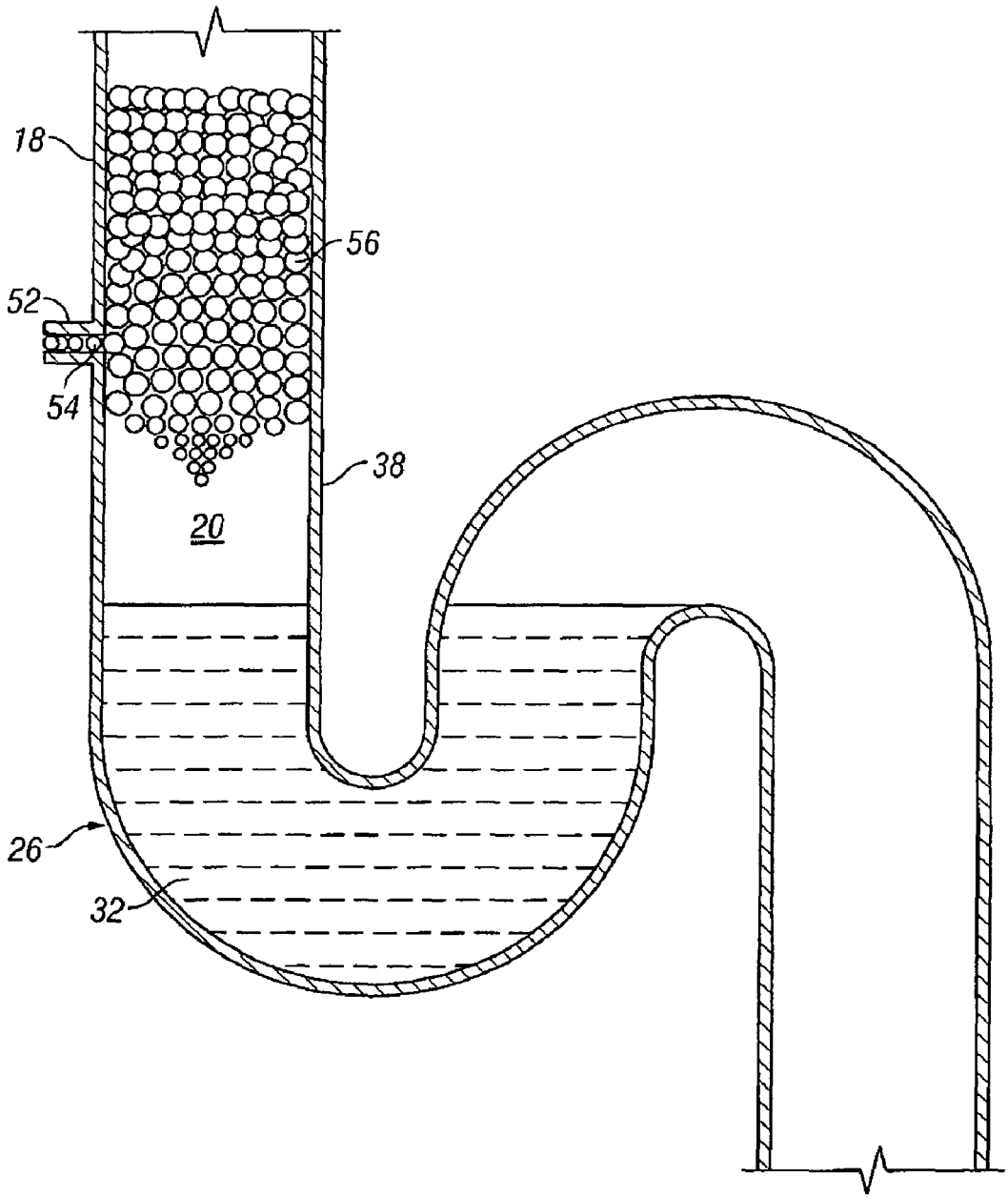

Reference is made to FIG. 11 in which the foam is discharged from a foam outlet 54 to form a foam plug 56 in which the surface adherence of the foam to the side wall 38 of the tube 18 is adequate to maintain the foam plug 56 in place across the passageway 20. Creation of a foam plug 56 in the embodiment of FIG. 11 can be aided by the foam being discharged rapidly in a large volume to almost instantly form the entire plug across the tube 18, and with the foam having a property of adhering to the wall 38.

The foam dispensing device 50 used in accordance with the present invention may have many different configurations. For example, a foam dispensing apparatus as shown in U.S. Pat. No. 6,409,050 to Ophardt may be used which will generate foam in a nozzle remote from the passageway and conduct the foam in a tube thereby transporting the foam along the tube to deliver the foam at a desired location in the discharge outlet. As taught in U.S. Pat. No. 7,364,053 to Ophardt, foam may be created proximate the discharge outlet by a separate tube, pressurized air and foamable fluid into a mixing chamber and foam generated proximate the discharge outlet.

Foam is formed by trapping gas bubbles in a liquid and may be considered a type of colloid. The foam of the foam plug 56 will have a stability which will depend upon a number of factors. The foam can be selected and its components and methods for formation configured to have varying stabilities and, therefore, varying lengths of time that the foam plug will remain stable and provide a barrier to odors passing upwardly therethrough. It is within the scope of a person skilled in the art to suitably select a foam for discharge into a given configuration of passageway and possible foam supports which will in combination provide a suitable foam life.

Soap dispensers are known which dispense hand soap for cleaning of a person's hand in the form of a foam. Experiments with typical such foam as are dispensed from conventional foam dispensing soap dispensers for dispensing hand cleaning foam has determined that when an allotment of foam is dispensed into a urinal assembly having a configuration as shown in FIG. 1 with an inner diameter of the discharge tube 18 of about one inch, and a distance between the lower support screen 34 and the upper support 36 of about two inches, a typical foam plug 56 which fills the cavity therebetween at normal room temperatures will have a foam life of about 30 minutes.

It is with the skill of persons skilled in the art to make a suitable selection of the liquid for the foam. Foams with high stability and long foam life are known in various applications including foams to be used as blankets to suppress the emission of oils, sewer gases and vapours and foams to be used for security systems and for firefighting. For example, U.S. Pat. No. 5,434,192 to Thach et al issued Jul. 18, 1995 teaches a high stability aqueous foam which persists for period of between 12 hours and several days at temperatures ranging from 75° F. to 105° F. U.S. Pat. No. 4,442,018 to Rand teaches compositions for stabilized aqueous foam with a foam life of about 60 minutes.

The foam which is to be used in the urinal preferably will be water based although this is not necessary. The foam preferably will be soluble in water and/or urine. The foam will preferably be biodegradable and permit admission to septic waste disposal systems without impairing the ability of such septic waste disposal systems to process the urine.

In accordance with the present invention, the foam plug will preferably have a foam life at least equal to 15 minutes, more preferably, at least 30 minutes or 1 hour or 12 hours. Insofar as a foam may have a foam life of 12 hours, this would permit a foam plug to remain in a urinal over an expected night period during low activity.

As a manner of operating a urinal assembly in accordance with the present invention, depending upon the relative time of day, and when, for example, a period of non-use of the urinal may be expected as, for example, which may occur with some urinals during the nighttime period, different steps may be taken to reduce odor during the nighttime than during the daytime. For example, at the start of a nighttime period, an enlarged allotment of foam may be injected or an allotment of foam may be injected having a different characteristic than foam which is to be injected periodically, say, every half hour during the daytime. Either a second foam dispensing device 50 could be provided or, alternatively, some different components or different concentration of the liquid may be used in forming a foam plug for use in the nighttime and to have a foam life to cover an expected period of inactivity. Alternatively, where the urinal uses water, prior to a period of activity, a quantity of water may be discharged to flush the urinal effectively changing the water in the S-trap and possibly without dispensing any foam plug during an expected period of inactivity.

In accordance with the present invention, the urinal assembly of FIG. 1 may be controlled and operated in a number of different manners. In a simplest manner, on start up, the urinal 12 may be provided with the sump portion 28 and its S-trap 26 filled with water or another suitable fluid. After a first person urinates in the urinal 12 and the urine has dropped down under gravity from the urinal 12 through the discharge outlet 16 and into the S-trap, the foam dispensing device 50 is activated to dispense an allotment of foam into the cavity 40, preferably adequate to fill the cavity. After dispensing the allotment of foam, dispensing is stopped. The foam plug 56 is created in the discharge tube 18 and is maintained in the passageway 20. At a time when a second person urinates in the urinal 12, the new urine passing through the passageway 20 typically will collapse, in whole or in part, any foam plug 56 which may be in existence. After the second person urinates, the foam dispensing device 50 is activated to dispense a new allotment of foam, again creating a new foam plug 56. The steps of successive persons urinating and, after each person urinating, a foam plug 56 being created from dispensed foam may be repeated successively. In this manner, a foam plug 56 may be maintained continuously in the urinal provided that between each person urinating in the urinal, the foam plug has not collapsed to such an extent that it does not block the passageway 20.

Having regard to the nature of the foam selected for the foam plug 56 and the characteristics of the discharge pipe and any support assembly, any given foam plug 56 may be determined to have an estimated foam plug life representing a reasonable estimate of the time that the foam plug will be effective to prevent odors from passing upwardly in the passageway 20. The foam plug life will be dependent upon many factors including the nature of the components in the liquid forming the foam, the size of the bubbles in the foam, the relative distribution and proportions of different size foam bubbles in the foam, as well as other factors such that temperature and humidity, the relative size, shape and relative proportions of the discharge tube 18 and the foam supports 34 and 36 and the like. Nevertheless, by simple experiment, it is within the skill of persons skilled in the art to test foam plugs and urinal discharge tube configurations and to determine in any configuration an approximate useful foam plug life. The foam plug life may be considered as an estimate of the time when the foam plug will prevent passage of odors upwardly through the drainpipe. On one hand, to be most cautious, the foam plug life may be considered as being the time period during which the foam plug may completely fill the cavity 40 between the lower support 34 and the upper support 36. On another hand, the foam plug life may be considered as being the time during which the foam plug continues to extend completely across the passageway 20.

After selecting a suitable foam plug life which will on the probability adequately prevent odor passage, the apparatus may be operated such that after any foam plug 56 is formed, once the selected foam plug life has passed, then the foam dispensing device 50 will be activated to dispense a new allotment of foam and create a new foam plug. Thus, insofar as there may be long periods of time between successive use of the urinal, successive new foam plugs will be formed automatically towards ensuring there is at all times an adequate foam plug 56 in place.

Successive foam plugs can be used in a waterless system avoiding the need for water or other liquid to operate the urinal. Rather than to operate any urinal to be totally waterless, using a foam plug of the present invention, any urinal may be operated with different preferably lesser water usage than normally used. For example, in a normal urinal, after each person urinates, water is flushed into the urinal to flush urine from the urinal and replace the liquid in the S-trap. In accordance with the present invention, after each person urinates but before the foam plug is formed, water may still be discharged into the urinal. The amount of water to be discharged after any usage may be controlled in many different manners. Of course, no water may be discharged. Water may be discharged in a minimal amount, for example, as a wetting amount to merely wet significant portions of the urinal which is urine is expected to contact and assist gravity flow of urine into the drain outlet. Water may be discharged in an intermediate amount, for example, as a washing amount to wash substantially all urine in the urinal into the drain outlet. Water may be discharged in a larger amount, for example, as a flushing amount to not only wash all the urine from the urinal but also substantially replace all water in the S-trap with fresh water.

Factors such as the number of times the urinal is used, the total time the urinal has been in use since last water washing or water flushing, the length of time the urinal has been left between any usages, the amount of water dispensed after each of the usages, the number foam plugs dispensed and the ambient temperature, can be used to develop algorithms to determine advantageous operating conditions towards minimizing water usage yet minimizing odor escape. For example, operation could be selected with water being discharged either to wet, wash or fully flush the urinal only periodically if the urinal is, for example, in constant usage. As an example, water may only be dispensed into the urinal in a wetting amount after each use, and a washing amount dispensed every ten flushes provided that at least 20 minutes have passed since the last washing amount was dispensed.

At the time that an existing foam plug may be desired to be replaced by a new foam plug, it is possible to operate the apparatus so as to dispense a small amount of water to assist in collapsing the existing foam plug before a new foam plug may be formed. Collapsing an existing foam plug is likely not necessary but might ensure that a preferred new foam plug is formed.

Systems in accordance with the present invention may include apparatuses and methods for determining if an adequate foam plug is in place in the passageway. One such sensing system would be a capacitive system in which the electrical capacitance or conductivity between the lower screen and the upper screen is measured, expecting that when a foam plug 56 is in place, the conductivity will be greater. For example, as seen in FIG. 2, the conductivity between the upper screen 36 and the lower screen 34 can be measured by a suitable electrical conductivity measuring device 100 electrically connected by wire 101 to the upper screen 36 and wire 102 to the lower screen 34.

Another foam plug sensing system may be adopted which uses the ability of light or other electromagnetic radiation to pass through the foam plug 56 as a measure of the foam plug. As seen in FIG. 2, an electromagnetic radiation sensor 58 may be placed on one side of the tube 18 so as to sense light passing from an electromagnetic radiation source or emitter 60 on the diametrically opposite side of the tube 18 through the foam plug. The foam plug 56 may be considered as adequate while the light sensor 58 senses light is below a predetermined level. As seen in FIG. 2, such an optical foam sensoring system is schematically shown with the light source or emitter 60 and the light sensor 58 located diametrically apart from each other on either side of the wall of the outlet pipe 18. Rather than pass sensing light radially through the foam the discharge pipe 18, light may be passed axially of the discharge pipe 18. For example, as seen in FIG. 8, another sensor 62 may be placed on the upper support 36 and an emitter 64 may be placed on the lower support 34 so that the light sensed by the sensor 62 represents the height of the foam plug 56. The emitters 60 or 64 may be eliminated and ambient light sensed through the waste outlet 16.

The foam dispensing device 50 may be configured to be operated manually or to be operated automatically and to varying extents automatically. In a simple manual system, the urinal may have a manually operated foam dispensing device 50. After urinating, a person would manually operate the foam dispensing device until, for example, as in the embodiments of FIGS. 8 and 9, the user may see foam rising up through the drain grate 84 giving an indication that the foam has adequately filled the discharge tube 18. Alternatively, a person could be instructed to merely operate the foam dispensing device for one or more operative strokes. A suitable foam dispensing device of the manual type may be similar to that disclosed in U.S. Pat. Nos. 6,409,050 or 6,601,736 to Ophardt et al.

In a more automated system, after urinating, a person could push a button which would automatically dispense any flushing water desired and then automatically operate an automatic foam dispensing system to discharge an allotment of foam. FIG. 1 schematically illustrates an apparatus with an automated control mechanism 73 to receive information from and to control various components including:

(a) a solenoid valve 66 controlling water flow from a pressurized water source 67 to a water flushing discharge outlet 68 in the urinal 12;

(b) the foam dispensing device 50 as an automated electrically powered dispenser;

(c) a sensing system 70 for sensing the presence of a person at a urinal including an emitter 71 and a sensor 72;

(b) a foam plug, sensing system, seen in FIG. 2, comprising sensor 58 and emitter 60 to sense the presence of an adequate foam plug.

The control mechanism 73 may include various clocks and timing mechanisms and various counters and recorders so as to consider, determine and record historical data on operation and use with a view to selecting advantageous operation of the various components, for example, by automatically keeping records of the time at which a person is sensed at the urinal, water is discharged and each foam plug is formed.

While the invention has been described with reference to preferred embodiments, many variations and modifications will occur to a person skilled in the art. For a definition of the invention, reference is made to the following claims.

We claim:

1. A method of constraining gas within an effluent discharge pipe of a urinal comprising discharging an allotment of collapsible foam comprising gas bubbles within a fluid inside the discharge pipe to form a replaceable, collapsible foam plug entirely across a passageway through the discharge pipe which foam plug is stable for a period of time, the method including providing a support for the foam in the discharge pipe, discharging the foam into the passageway of the discharge pipe above the support so that the foam engages the support, and providing as the support a lower screen member disposed across the passageway and an upper screen member disposed across the passageway, the method including discharging the foam into the discharge pipe intermediate the lower screen member and the upper screen member in a manner that the foam entirely fills a cavity defined within the passageway through the discharge pipe between the upper screen member and the lower screen member, including discharging sufficient foam that the foam fills the cavity engaging each of the upper screen member and the lower screen member.

2. A method as claimed in claim 1 including providing the discharge pipe with a restriction section of reduced cross-sectional area providing the support within the restriction section.

3. A method as claimed in claim 1 comprising, after forming the foam plug, discharging a liquid down the discharge pipe to at least partially collapse the foam plug and thereafter discharging a new allotment of collapsible foam inside the discharge pipe to form a replacement collapsible foam plug.

4. A method as claimed in claim 3 wherein the foam plug has a foam plug life representing an estimated time the foam plug will, after being formed in the pipe, remain intact without collapsing to such an extent that it does not extend across the passageway of the discharge pipe, the method wherein after any foam plug has been in the passageway for a period of time less than the foam life discharging a new allotment of foam into the discharge pipe to form a new replacement foam plug.

5. A method as claimed in claim 1 including periodically discharging successive allotments of foam into the discharge pipe to provide at successive time intervals a new replacement foam plug in the passageway.

6. A method as claimed in claim 1 the method including discharging urine or other liquid into the urinal to flow down the discharge pipe to at least partially collapse the foam plug and, after or at least partially collapsing the foam plug, discharging foam to form a new foam plug.

7. A method as claimed in claim 6 wherein the discharge pipe includes a trap to retain liquid therein, the method including disclosing foam into the discharge pipe to form in the discharge pipe upstream from liquid retained in the trap.

8. A method as claimed in claim 7 wherein after each time that a person uses the urinal by discharging urine into the urinal, a new allotment of foam is discharged into the discharge pipe to form a new foam plug.

9. A method as claimed in claim 1 including one or more of the following steps: automatically sensing the presence of a person at the urinal, automatically actuating discharges of water into the urinal, automatically controlling the dispensing of foam into the passageway to form successive foam plugs, and automatically keeping records of the time at which a person is sensed at the urinal, water is discharged and each foam plug is formed.

10. A method as claimed in claim 1 wherein the foam plug being sufficient to block the passageway and substantially prevent passage of odors in the passageway below the foam plug through the passageway therepast.

11. A method as claimed in claim 1 including automatically sensing the presence of the foam plug in the passageway.

12. A method as claimed in claim 11 including providing an emitter of electromagnetic radiation and a sensor of electromagnetic radiation located such that electromagnetic radiation from the emitter must pass through a cavity in the discharge pipe in which the foam plug is desired to be located, and determining whether the foam plug is adequately blocking the passageway to odor passage by the extent that the electromagnetic radiation emitted by the emitter reaches the sensor.

13. A method as claimed in claim 11 wherein the presence of the foam plug is sensed by sensing the electrical capacitance or conductivity between the lower screen member and the upper screen member.

14. A method of constraining gas within an effluent discharge pipe comprising discharging an allotment of collapsible foam comprising gas bubbles within a fluid inside the discharge pipe to form a replaceable, collapsible foam plug entirely across a passageway through the discharge pipe which foam plug is stable for a period of time, including automatically sensing the presence of a foam plug in the passageway by providing an emitter of electromagnetic radiation and a sensor of electromagnetic radiation located such that electromagnetic radiation from the emitter must pass through a cavity in the discharge pipe in which the foam plug is desired to be located, and determining whether the foam plug is adequately blocking the passageway to odor passage by the extent that the electromagnetic radiation emitted by the emitter reaches the sensor.

15. A method as claimed in claim 14 wherein the discharge pipe is a discharge pipe of a urinal, the method including discharging urine or other liquid into the urinal to flow down the discharge pipe to at least partially collapse the foam plug and, after partially collapsing the foam plug, discharging foam to form a new foam plug after use of the urinal, providing a support for the foam in the discharge pipe, the support comprising a lower screen member disposed across the passageway and an upper screen member disposed across the passageway, the method including discharging the foam into the discharge pipe intermediate the lower screen and the upper screen in a manner that the foam entirely fills a cavity defined within the passageway through the discharge pipe between the upper screen member and the lower screen member, including discharging sufficient foam that the foam fills the cavity engaging each of the upper screen member and the lower screen member.

* * * * *